US010274149B2

(12) United States Patent
Workman et al.

(10) Patent No.: US 10,274,149 B2
(45) Date of Patent: Apr. 30, 2019

(54) BEACON PENDANT LIGHT

(71) Applicant: Barebones Systems, LLC, Salt Lake City, UT (US)

(72) Inventors: Robert Emmett Workman, Morgan, UT (US); Henry Howell, Herriman, UT (US); Kristin Mecham, Springville, UT (US); Michelle Ann Merrill, Draper, UT (US); David Jared Burton, Payson, UT (US); Erik Robert Workman, Salt Lake City, UT (US)

(73) Assignee: BAREBONES SYSTEMS, LLC, Salt Lake City, UT (US)

( * ) Notice: Subject to any disclaimer, the term of this patent is extended or adjusted under 35 U.S.C. 154(b) by 73 days.

(21) Appl. No.: 15/667,530

(22) Filed: Aug. 2, 2017

(65) Prior Publication Data

US 2018/0128435 A1 May 10, 2018

Related U.S. Application Data

(60) Provisional application No. 62/370,088, filed on Aug. 2, 2016.

(51) Int. Cl.

| | |
|---|---|
| ***F21S 9/02*** | (2006.01) |
| ***F21V 7/28*** | (2018.01) |
| ***F21V 3/06*** | (2018.01) |
| ***F21V 3/02*** | (2006.01) |
| ***F21V 21/088*** | (2006.01) |
| ***F21V 21/30*** | (2006.01) |

(Continued)

(52) U.S. Cl.

CPC ..... *F21S 9/02* (2013.01); *F21V 3/02* (2013.01); *F21V 3/062* (2018.02); *F21V 7/28* (2018.02); *F21V 21/088* (2013.01); *F21V 21/0832* (2013.01); *F21V 21/30* (2013.01); *F21V 23/04* (2013.01); *F21V 31/00* (2013.01); *F21V 21/06* (2013.01); *F21W 2111/00* (2013.01); *F21Y 2103/33* (2016.08); *F21Y 2115/10* (2016.08)

(58) Field of Classification Search

CPC .... F21S 9/02; F21V 7/28; F21V 23/04; F21V 21/0832; F21V 21/30; F21V 31/00; F21V 21/088; F21V 3/062; F21V 3/02; F21V 21/06; F21Y 2115/10; F21Y 2103/33; F21W 2111/00

See application file for complete search history.

(56) References Cited

U.S. PATENT DOCUMENTS

| | | | |
|---|---|---|---|
| 1,121,420 A | 12/1914 | Tizley | |
| 4,286,310 A | 8/1981 | Brainkel et al. | |

(Continued)

FOREIGN PATENT DOCUMENTS

| | | | |
|---|---|---|---|
| WO | WO-2006020687 A1 * | 2/2006 | ..... F21L 4/08 |
| WO | WO-2014199684 A1 * | 12/2014 | ..... F21V 7/0008 |

*Primary Examiner* — Anh T Mai
*Assistant Examiner* — Glenn D Zimmerman
(74) *Attorney, Agent, or Firm* — Morriss O'Bryant Compagni Cannon, PLLC

(57) ABSTRACT

A battery-operated pendant beacon light comprises a base housing forming a lens, an upper housing coupled to the base housing, a battery compartment coupled to the upper housing and extending into the base housing, a rotatable switch coupled to a top of the upper housing with a hook assembly coupled to the dimmer switch. A plurality of lights is coupled to the upper housing and shine light into the lower housing.

15 Claims, 8 Drawing Sheets

(51) Int. Cl.

| | |
|---|---|
| ***F21V 23/04*** | (2006.01) |
| ***F21V 31/00*** | (2006.01) |
| ***F21V 21/08*** | (2006.01) |
| *F21V 21/06* | (2006.01) |
| *F21W 111/00* | (2006.01) |
| *F21Y 115/10* | (2016.01) |
| *F21Y 103/33* | (2016.01) |

(56) References Cited

U.S. PATENT DOCUMENTS

| | | | | |
|---|---|---|---|---|
| D491,302 | S | 6/2004 | Krieger et al. | |
| D576,329 | S | 9/2008 | Poon | |
| D629,746 | S | 12/2010 | Workman et al. | |
| D646,412 | S | 10/2011 | Taiga | |
| D648,055 | S | 11/2011 | Poon | |
| 8,080,972 | B2 | 12/2011 | Smith | |
| D651,564 | S | 1/2012 | Workman et al. | |
| D652,554 | S | 1/2012 | Leung et al. | |
| D664,499 | S | 7/2012 | Workman et al. | |
| D670,244 | S | 11/2012 | Workman et al. | |
| 8,434,894 | B2 | 5/2013 | Workman et al. | |
| D693,765 | S | 11/2013 | Workman et al. | |
| D695,680 | S | 12/2013 | Workman et al. | |
| D697,028 | S | 1/2014 | Workman et al. | |
| D716,726 | S | 11/2014 | Workman et al. | |
| D717,987 | S | 11/2014 | Prommel et al. | |
| D723,205 | S | 2/2015 | Prommel et al. | |
| 9,024,570 | B2 | 5/2015 | Workman et al. | |
| D739,381 | S | 9/2015 | Workman et al. | |
| 9,182,088 | B2 | 11/2015 | Workman et al. | |
| D744,680 | S | 12/2015 | Ma | |
| D753,059 | S | 4/2016 | Krantz et al. | |
| 9,312,706 | B2 | 4/2016 | Workman et al. | |
| 9,362,766 | B2 | 6/2016 | Workman et al. | |
| 9,385,351 | B2 | 7/2016 | Workman et al. | |
| 9,388,953 | B2 | 7/2016 | Workman et al. | |
| D764,087 | S | 8/2016 | Workman et al. | |
| D773,703 | S | 12/2016 | Krantz et al. | |
| D773,992 | S | 12/2016 | Krantz et al. | |
| D774,228 | S | 12/2016 | Workman et al. | |
| 9,515,500 | B2 | 12/2016 | Workman et al. | |
| 9,553,481 | B2 | 1/2017 | Prommel et al. | |
| D787,104 | S | 5/2017 | Wu | |
| D797,045 | S | 9/2017 | Krantz et al. | |
| D809,687 | S | 2/2018 | Krantz et al. | |
| D810,979 | S | 2/2018 | Krantz et al. | |
| D813,162 | S | 3/2018 | Krantz et al. | |
| 2002/0034073 | A1 | 3/2002 | Halasz | |
| 2005/0265035 | A1 | 12/2005 | Brass et al. | |
| 2010/0053942 | A1* | 3/2010 | Tarter | F21L 2/00 362/182 |
| 2010/0084997 | A1 | 4/2010 | Oberzeir et al. | |
| 2011/0116254 | A1 | 5/2011 | Workman et al. | |
| 2012/0182723 | A1* | 7/2012 | Sharrah | F21V 29/004 362/157 |
| 2013/0043826 | A1 | 2/2013 | Workman et al. | |
| 2014/0321106 | A1 | 10/2014 | Workman et al. | |
| 2016/0013675 | A1 | 1/2016 | Workman et al. | |
| 2016/0037253 | A1 | 2/2016 | Workman et al. | |
| 2016/0195235 | A1 | 7/2016 | Workman et al. | |
| 2017/0047755 | A1 | 2/2017 | Workman et al. | |

* cited by examiner

BEACON PENDANT LIGHT

CROSS-REFERENCE TO RELATED APPLICATION

The present application claims priority to U.S. Provisional Patent Application Ser. No. 62/370,088, filed on Aug. 2, 2016, the entirety of which is incorporated by this reference.

BACKGROUND

Field of the Invention

The present invention relates generally to battery-operated lights and more specifically to portable battery-operated lights.

State of the Related Art

Battery-operated flashlights have been available for decades. Work lights are another form of battery-operated lights that may include a base for standing the work light on its end or a hook to allow the work light to be hung from a structure. There exists a need in the art, however, to provide a light that is capable of being operated in a standing or hanging position that can also be activated, dimmed or deactivated in a simple manner.

SUMMARY OF THE INVENTION

Accordingly, the present invention provides an improved battery-operated beacon pendant light that can be operated in a standing or hanging position. The pendant light of the present invention includes a clear base portion that provides a stand for the beacon light, an upper housing portion that houses the electronics and LED lights and a hook assembly, that may be in the form of a carabineer that is coupled to a switch at the top of the upper housing to allow one hand operation of the beacon light. A battery compartment is provided in the center of the base portion to allow easy access to the battery for replacement.

According to one aspect of the invention, a battery-operated pendant light comprises a base housing having an outer wall forming a lens, an upper housing coupled to the base housing, a plurality of lights coupled to the upper housing to direct light from the plurality of lights into the base housing, a battery compartment coupled to the upper housing and extending into and centrally located within the base housing, with the battery compartment configured to retain at least one battery therein, and a rotatable electrical switch coupled to a top of the upper housing and a hook assembly coupled to the switch, wherein rotation of the hook assembly relative to the upper housing in a first direction moves the switch from an off position to an on position and wherein rotation of the hook assembly relative to the upper housing in a second direction opposite the first direction moves the switch from an on position to an off position, the rotatable switch being electrically coupled between the battery housing and the plurality of lights to thereby control illumination of the plurality of lights.

In another embodiment of the invention, a USB port is electrically coupled to the battery housing to provide a charging capability from the USB port.

In yet another embodiment, a USB cable is electrically coupled between the USB port and the battery compartment. The USB cable is removably nestable within a channel beneath a lip portion of the upper housing and at least partially circumferentially extends around the base housing when in a nested position.

In still another embodiment, the base housing is generally cylindrical in shape and comprises a plurality of feet integrally formed with and radially extending from the bottom of the base housing to support the battery-operated pendant light on a surface.

In another embodiment, the hook assembly comprises a carabineer that is pivotally coupled to a knob that is coupled to the switch to allow the hook assembly to pivot from an upright position to a lower position.

In yet another embodiment, rotating the base housing or the upper housing relative to the hook assembly in a first direction rotates the switch assembly from an on position to an off position and rotating the base housing or the upper housing relative to the hook assembly in a second direction rotates the switch assembly from an off position to an of position.

In yet another embodiment, the hook assembly comprises an upper hook portion coupled to an arcuate base portion. The arcuate base portion is pivotally coupled to the knob at opposite sides thereof and in a pivotal manner to allow the base portion and thus the hook portion to pivot relative to the knob at least 180 degrees.

In still another embodiment, a first distal end of the arcuate base portion is coupled to the knob with a pin portion that extends at least partially into a first aperture formed in a side of the knob. A second distal end of the arcuate base portion is coupled to the knob with a fastener that extends through a hole in the second distal end of the arcuate base portion and into a second aperture in an opposite side of the knob. This allows the hook assembly to pivot about a pivot axis that extends through the pin portion and the fastener so that when the knob is rotated by the hook assembly, the switch can be rotated between an off position and an on position.

In yet another embodiment, the battery compartment is generally cylindrical in shape and is threadedly coupled at an upper end thereof to a plate assembly that forms a bottom portion of the upper housing. The battery compartment is removable from the plate assembly.

In another embodiment, the base housing is releasably coupled to the plate assembly by a plurality of retaining members that extend through a corresponding plurality of slotted apertures in the plate assembly. The plurality of retaining members each form a hook that is at least partially inserted through a corresponding one of the plurality of slotted apertures so that when the base housing is rotated relative to the upper housing, the plurality of retaining members snap lock relative to the plate assembly to releasably hold the base housing to the upper housing.

In still another embodiment, the plurality of lights are coupled to a bottom of the plate assembly and arranged radially around the battery compartment so as to direct light into the base housing.

In yet another embodiment, an exterior surface of the battery compartment and a bottom surface of the plate assembly are covered with a reflective material to direct substantially all of the light from the plurality of lights through the base portion in order to maximize brightness of the plurality of lights.

In another embodiment, the base housing has a generally cylindrical shape with a dome shaped bottom portion and includes a plurality of radially extending curved rib portions that form a plurality of partial toroidal surfaces that circumferentially extend around and form the outer surface of the base portion.

In still another embodiment, the plate assembly defines a channel that circumferentially extends along the bottom of the plate assembly and is sized to receive a USB cable having a USB port attached to one end of the USB cable, the USB cable electrically coupled to a battery within the battery compartment.

In yet another embodiment, a USB port housing coupled to the plate assembly for removably retaining the USB port therein.

These and other aspects of the present invention may be realized in an improved pendant light as shown and described in the following figures and related description.

BRIEF DESCRIPTION OF THE DRAWINGS

When considered in connection with the following illustrative figures, a more complete understanding of the present invention may be derived by referring to the detailed description. In the figures, like reference numbers refer to like elements or acts throughout the figures. Various embodiments of the present invention are shown and described in reference to the numbered drawings.

Figure 1:
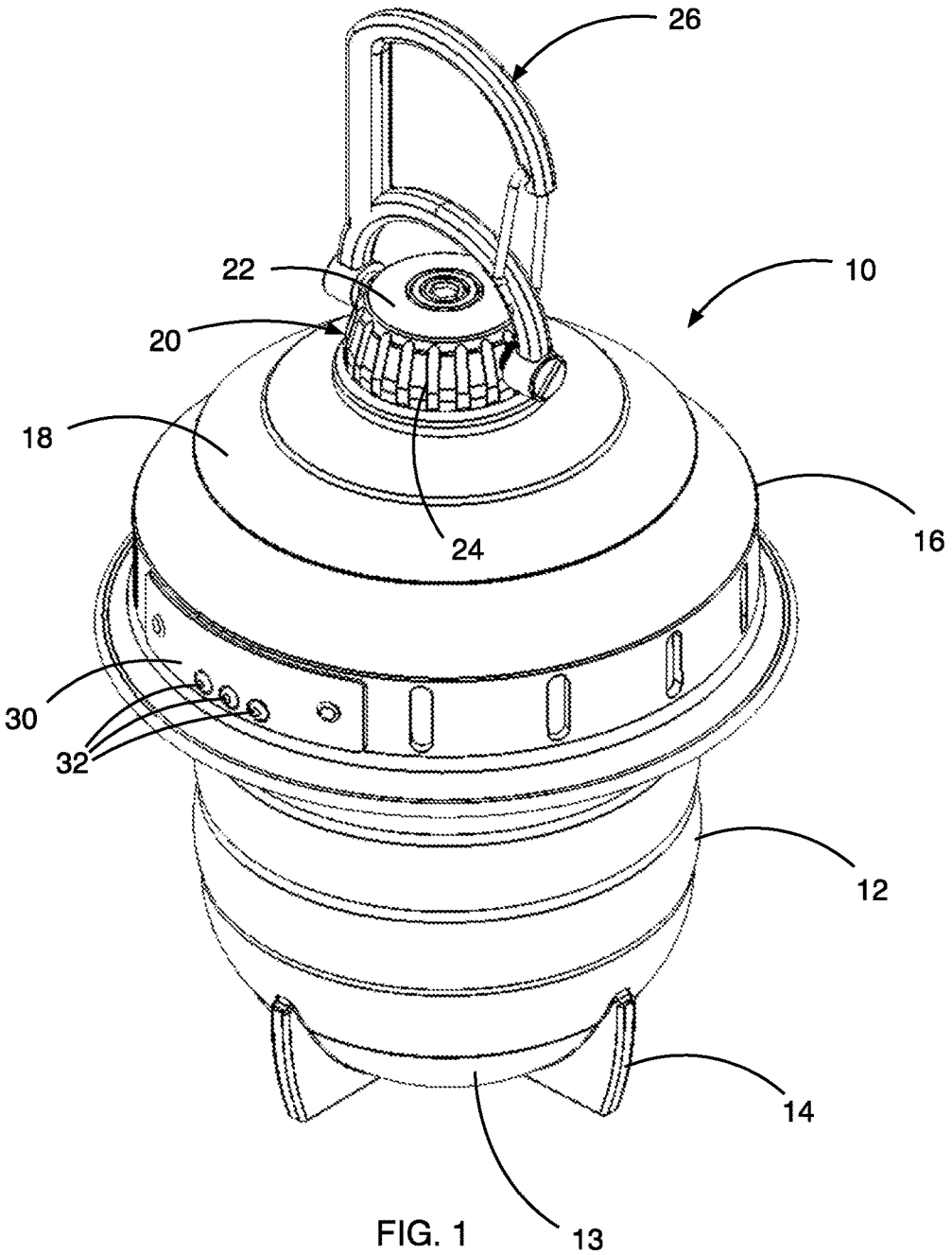
FIG. 1 is a perspective front side view of a beacon pendant light in accordance with the principles of the present invention.

It will be appreciated that the drawings are illustrative and not limiting of the scope of the invention, which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention. Elements and acts in the figures are illustrated for simplicity and have not necessarily been rendered according to any particular sequence or embodiment.

DETAILED DESCRIPTION OF THE ILLUSTRATED EMBODIMENTS

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims. Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as his own lexicographer, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors fully informed of the standards and Application of the special provisions of 35 U.S.C. § 112, ¶ 6. Thus, the use of the words "function," "means" or "step" in the Detailed Description of the Invention or claims is not intended to somehow indicate a desire to invoke the special provisions of 35 U.S.C. § 112, ¶ 6, to define the invention. To the contrary, if the provisions of 35 U.S.C. § 112, ¶ 6 are sought to be invoked to define the inventions, the claims will specifically and expressly state the exact phrases "means for" or "step for" and the specific function (e.g., "means for filtering"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. § 112, ¶ 6. Moreover, even if the provisions of 35 U.S.C. § 112, ¶ 6 are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. Thus, the full scope of the inventions is not limited to the examples that are described below.

FIG. 1 illustrates a beacon pendant light, generally indicated at 10, in accordance with the principles of the present invention. The light 10 includes a base portion 12 formed from clear or light permeable plastic to form the lens of the light through which light is transmitted from inside the base portion 12. The base portion 12 is generally cylindrical in shape with a dome shaped bottom 13 with a plurality of feet 14 integrally formed with and radially extending from the bottom of the base 12 to allow the light 10 to be placed on and supported on a surface without tipping over. The base portion 12 is coupled to an upper housing 16 in a removable manner. The upper housing 16 is comprised of a dome shaped top portion 18. At the top of the dome shaped top portion 18 is a switch assembly 20. The switch assembly 20 is rotatable relative to the top portion 18 from between a first off position to a second on position. The switch assembly 20 includes a rotatable knob 22 having grasping ridges 24. A hook assembly 26 in the form of a carabineer is pivotally coupled to the knob to allow the hook assembly 26 to pivot from an upright position when the light 10 is hung therefrom, as shown, to a lower position where the hook assembly 26 can rest upon the top portion 18. When the light 10 is hung by the hook assembly 26, rotating the light 10 by grasping and twisting the base portion 12 or the top portion 18, thereby turning the hook assembly 26 and switch assembly 20 relative to the top portion 18, allows operation and control of the light switch assembly 20 from an on position to an off position or vise versa with a single hand. As will be described in more detail, the switch assembly 20 may include a dimmer switch so that rotation of the knob 22 relative to the top portion 18 may control the brightness of the lights within the base portion 12 between the off position and the fully on position.

A battery indicator 30 is attached to the top portion 18 along an outer rim thereof and includes a plurality of LED lights 32 which indicate, by the number of illuminated LED lights 32, the amount of charge left in the battery. That is, where all three LED lights 32 are illuminated, the battery may be fully charged or nearly fully charged. When two lights 32 are illuminated, the battery may be between about 50 percent and 75 percent charged. When only one of the plurality of lights 32 is illuminated, the battery may be between about 25 and 50 percent charged and when no lights 32 are illuminated, the battery may be less than 25 percent charged or fully or nearly fully depleted such that the light 10 will not illuminate.

Figure 2:
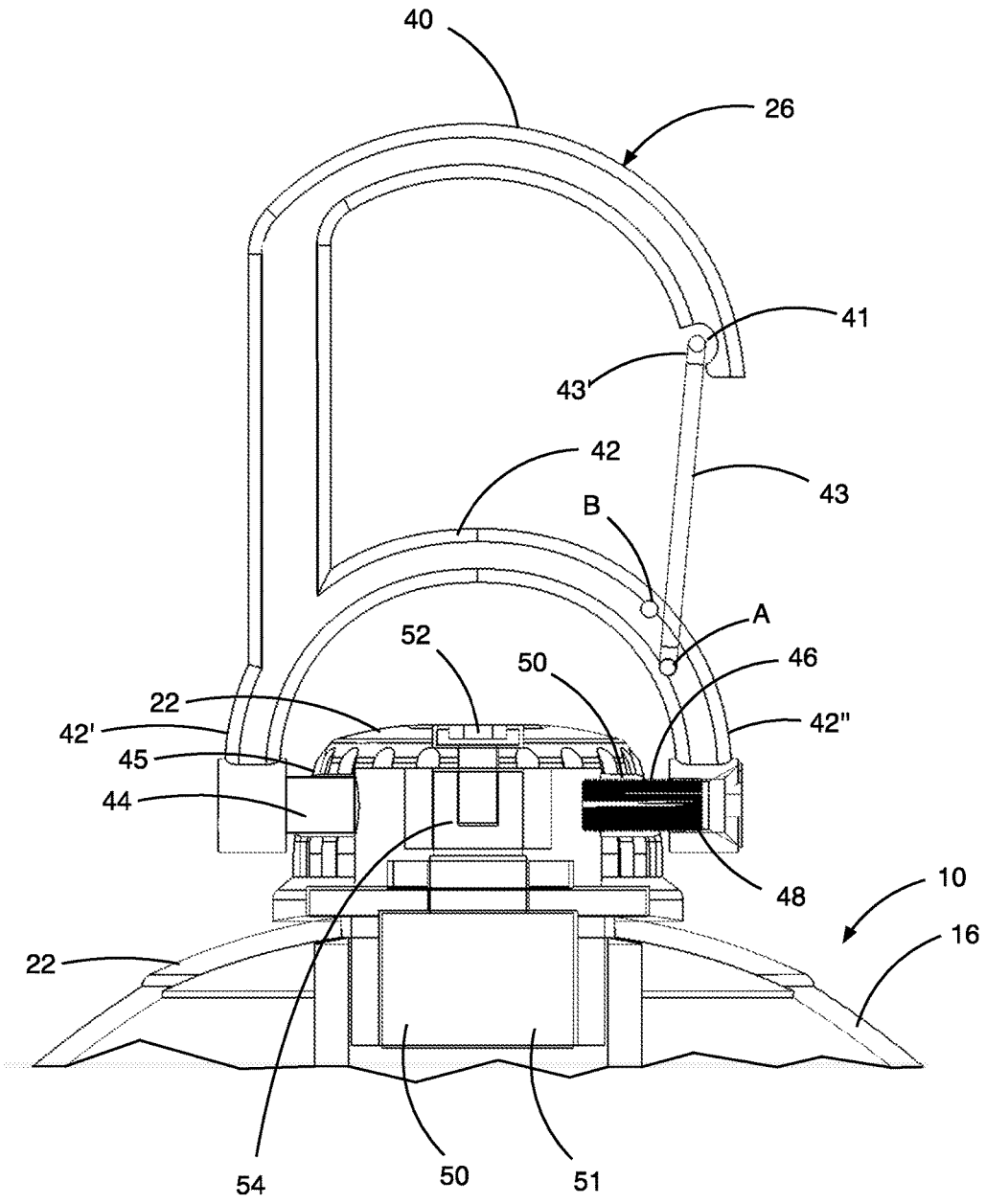
FIG. 2 is a partial cross-sectional side view of a top portion of the beacon pendant light shown in FIG. 1.

As shown in FIG. 2, the hook assembly 26 is in the form of a carabineer having an upper hook portion 40 coupled to a semicircular, arcuate base portion 42 that extends from proximate one side of the knob 22 to an opposite side of the knob 22 and has a diameter that is greater than a diameter of the knob 22 so that the arcuate base portion 42 can pivot relative to the knob 22 at least 180 degrees without interference from contacting the knob 22. A biased retaining rod 43 that forms a hook is coupled to the base portion 42 at two points A and B so that its upper portion 43' is biased toward an inside recess 41 of the upper hook portion 40 but can be moved inwardly to allow passage of an object (such as a roof support pole of a tent) from which the hook assembly 26 can be hung. The base portion 42 is pivotally coupled to the knob 22 at opposite sides thereof and in a pivotal manner to allow the base portion 42 and thus the hook portion 40 to pivot relative to the knob 22 more than 180 degrees. The distal ends 42' and 42" of the base portion 42 are attached to the knob 22 with a pin portion 44 that extends at least partially into an aperture 45 formed in the side of the knob 22. A threaded fastener 46 extends through an aperture 48 in the distal end of the base portion 42 and into a threaded aperture 50 in the knob 22 opposite the aperture 45 in the knob 22. The distal end 42" can freely pivot relative to the fastener 46. This allows the hook assembly 26 to pivot about a pivot axis that extends through the pin portion 44 and fastener 46 and thus relative to the knob 22, but when the hook assembly 26 is attached to another structure and the light 10 is twisted, the knob 22 will be rotated by the hook assembly 26 relative to the top portion 18 of the light 10. The knob 22 is coupled to a rotatable switch 50 that is operable between an "off" position and an "on" position. The rotatable switch includes a click feature that provides resistance between the "off" position and an "on" position so that the user can feel when the knob 22 has been fully rotated into the off position and conversely when the knob 22 and switch 50 have been rotated out of the "off" position. The switch 50 may comprise a dimmer switch that varies the voltage between the battery (not shown) of the light 10 and the LED lights (not shown) from a minimum voltage output where the LED lights are in a dimmed state (when the switch 50 is rotated to a first "on" position that is just past the "off" position) to a maximum voltage output where the LED lights are in a full brightness state (when the switch 50 is rotated to a second "on" position that is at the end of the full allowable rotation of the switch 50). The knob 22 is coupled to the switch 50 with fastener 52 that is coupled to a switch stem 54 that extends from the switch 50. The body 51 of the switch 50 is coupled to the upper portion 18 of the upper housing 16 in a manner that prevents rotation of the switch body 51 from rotating relative to the upper portion 18 of the upper housing 16 when the knob 22 is rotated. The switch 50 may be a simple rotatable on off switch or, as described above, a dimmable switch containing a potentiometer that varies the voltage to the lights (not shown) to provide a dimming feature so that the lights can be turned fully on in the fully "on" position of the switch 50 or set at various dim settings between the fully "on" position and the "off" position of the switch 50 to control the overall brightness of the light 10.

Figure 3:
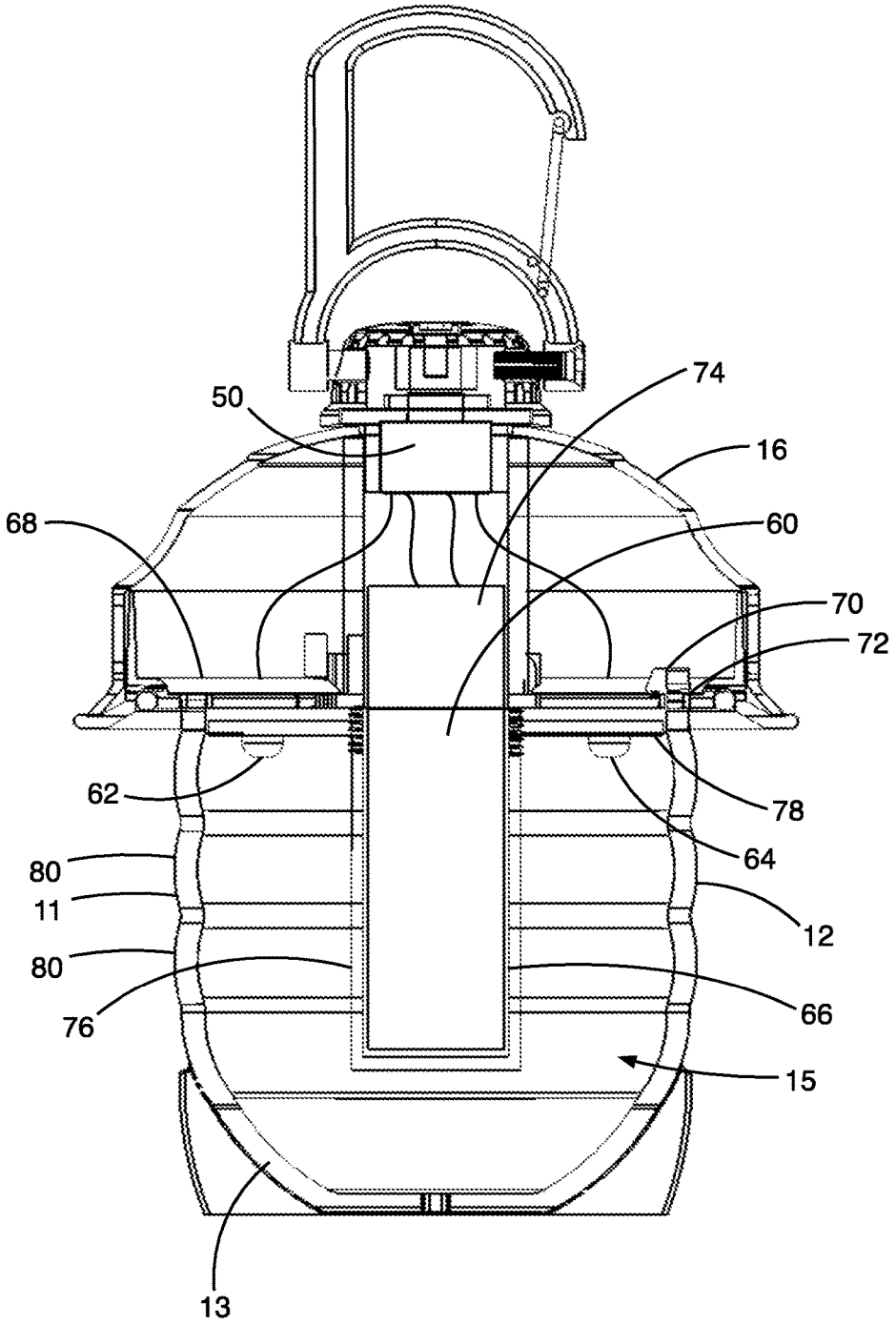
FIG. 3 is a cross-sectional side view of the beacon pendant light shown in FIG. 1.
Figure 8:
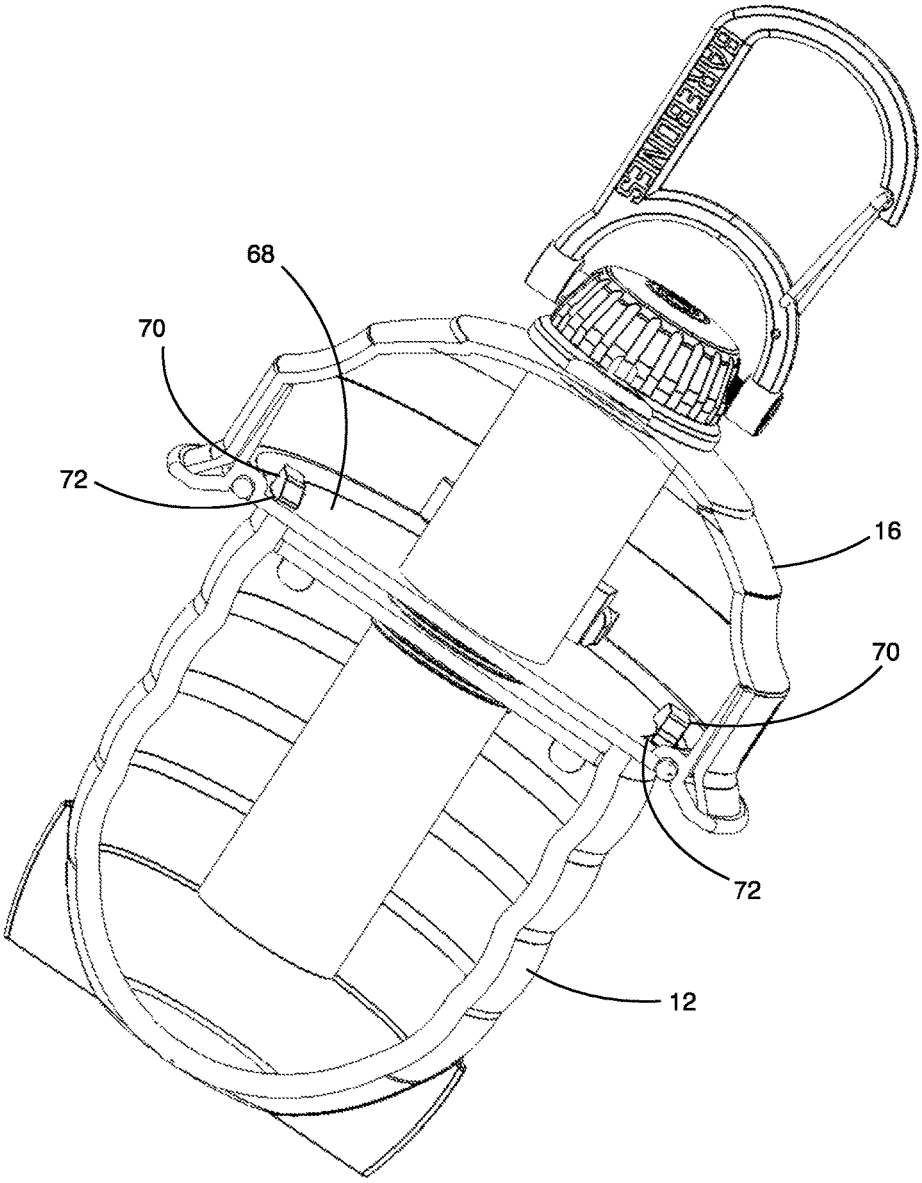
FIG. 8 is a partial cross-sectional side view of the beacon pendant light shown in FIG.

As shown in FIG. 3, the switch 50 is electrically coupled between a battery 60 and lights 62 and 64 so that the switch 50 controls electrical power to the lights 62 and 64. The battery 60 is housed within and supported by a battery housing 66 that is threadedly coupled at an upper end thereof to a plate assembly 68 forming the bottom portion of the upper housing 16. As also shown in FIG. 8, the base portion 12 is releasably coupled to the plate assembly 68 by retaining members 70 that extend through slotted apertures 72 in the plate assembly 68. The retaining members 70 essentially form hooks that are inserted through the slotted apertures 72. After insertion, when the base portion 12 is rotated relative to the upper housing 16, the retaining members 70 snap lock relative to the plate assembly 68 to releasably hold the base portion 12 to the upper housing 16. To remove the base portion 12 from the upper housing 16, the base portion 12 is rotated in an opposite direction to release the retaining members 70 from the plate assembly 68. The force necessary to remove the base portion 12 from the upper housing 16 is greater than the force required to turn the switch 50 from the "off" position to the "on" position or from the "on" position to the "off" position.

The threaded upper portion of the battery housing 66 is threaded into a threaded aperture in the plate assembly 68 to secure the battery 60. Once the base portion 12 is removed, the battery housing 66 can be unscrewed from the plate assembly 68 to release and remove the battery from the light 10. The battery 60 can then be easily replaced if needed. When the battery housing 66 is fully engaged with the plate assembly 68, the terminals of the battery 66 are in electrical contact with electrical contacts provided in the battery housing and/or the contacts of the battery connector 74.

Lights 62 and 64 are coupled to a bottom of the plate assembly 68 so as to be configured to direct light into the base portion 12. Because the base portion 12 is clear or otherwise substantially light transparent, light from the lights 62 and 64 is passed through the base portion 12. While only two such lights 62 and 64 are shown, a plurality of such lights in a radial arrangement may be provided around the plate assembly so that the base portion 12 is substantially evenly lit around the entire circumference of the base portion 12. The exterior surface 76 of the battery compartment 66 and the bottom surface 78 of the plate assembly 68 may be coated with a reflective paint or film in order to direct substantially all of the light from the lights 62 and 64 through the base portion 12 in order to maximize brightness of the light 12.

As previously mentioned, the base portion 12 has a generally cylindrical shape with a dome shaped bottom portion 13 and defines an inner chamber 15 having a generally cylindrical shape that extends from proximate the plate assembly 68 to the bottom portion 13. The outer wall 11 of the base portion 12 is comprised of a plurality of radially extending curved rib portions 80, that form a plurality of partial toroidal surfaces 80' that circumferentially extend around and form the outer surface of the base portion 12. These partial toroidal surfaces 80' help to disperse light from the lights 62 and 64 in a radial manner and from top to bottom of the base portion 12. That is, the ribbed configuration of the base portion 12 helps to more evenly and uniformly disperse light from the base portion 12 even thought the lights 62 and 64 are positioned at the top of the base portion 12. The outer wall 11 is spaced from the battery housing 66 on all sides so that light from the lights 62 and 64 can spread by light reflective properties throughout the base portion 12 to illuminate the entire base portion 12.

Figure 4A:
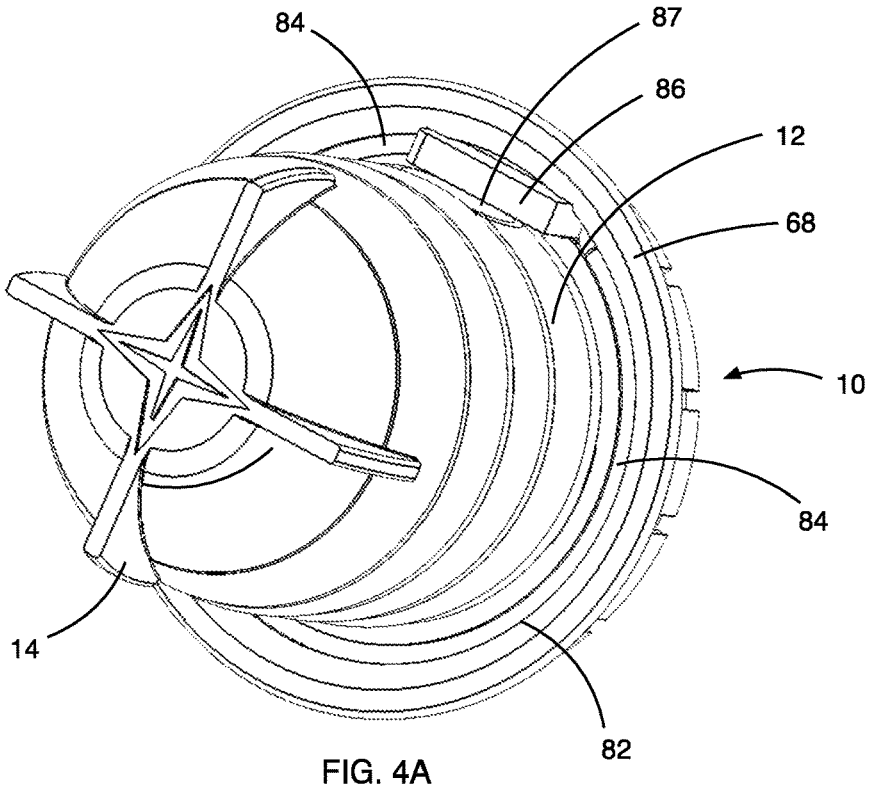
FIG. 4A is a bottom view of a bottom portion of the beacon pendant light shown in FIG. 1.
Figure 4B:
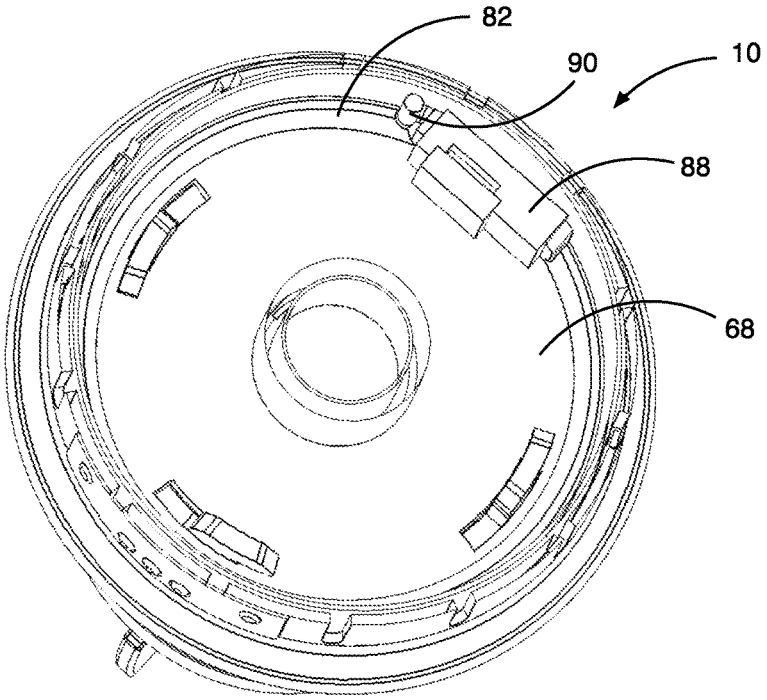
FIG. 4B is a top view of the bottom portion of the beacon pendant light shown in FIG. 4A.

As shown in FIGS. 4A and 4B, the plate assembly 68 defines a radial channel 82 that circumferentially extends along the bottom of the plate assembly 68. The channel 82 is semicircular in cross-section to receive a USB cable 84 having a USB port 86 attached to one end of the cable 84. The USB port 86 is retained within a USB port housing 88 coupled to the plate assembly 68. The lower portion 12 is provided with a flattened surface portion 87 to accommodate the USB port 86 along the side of the lower portion 12. By positioning the channel 82 proximate an outer edge of the base plate 68, a length of the USB cable 84 can be maximized while still being completely retained within the base plate 68 when stored. The end 90 of the USB cable opposite the USB port 86 passes through the base plate 68 and into the upper housing to be connected to the battery via proper circuitry to provide USB charging capability for various electronic devices that are chargeable through a USB connection, such as smart phones, tablets, GPS devices and others known in the art. The USB port 86 can also be used to charge the battery 60 (see FIG. 3) by plugging a charging cable connected to a power supply (not shown) into the USB port 86. The channel 82 has a semicircular cross-section for retaining the USB cable 84, which has a circular cross-section. The size of the channel 82 provides a friction fit with the cable 84 to hold the cable within the channel 82 when pressed therein. To remove the cable 84, the USB port 86, which is also retained by friction fit, can be grasped and pulled from its housing 88. Continuing to pull the USB port 86 causes the rest of the USB cable 84 from being removed from the channel 82. Depending on the diameter of the base plate 68, the length of the USB cable 84 can range from about 18 inches for a 6 inch diameter base plate to about 12 inches for a 4 inch diameter base plate. As such, the light 10 can provide USB charging capability with an adequately long cable to reach a USB chargeable device that may be resting on a surface next to the light 10 when the light 10 is resting upon feet 14.

Figure 5:
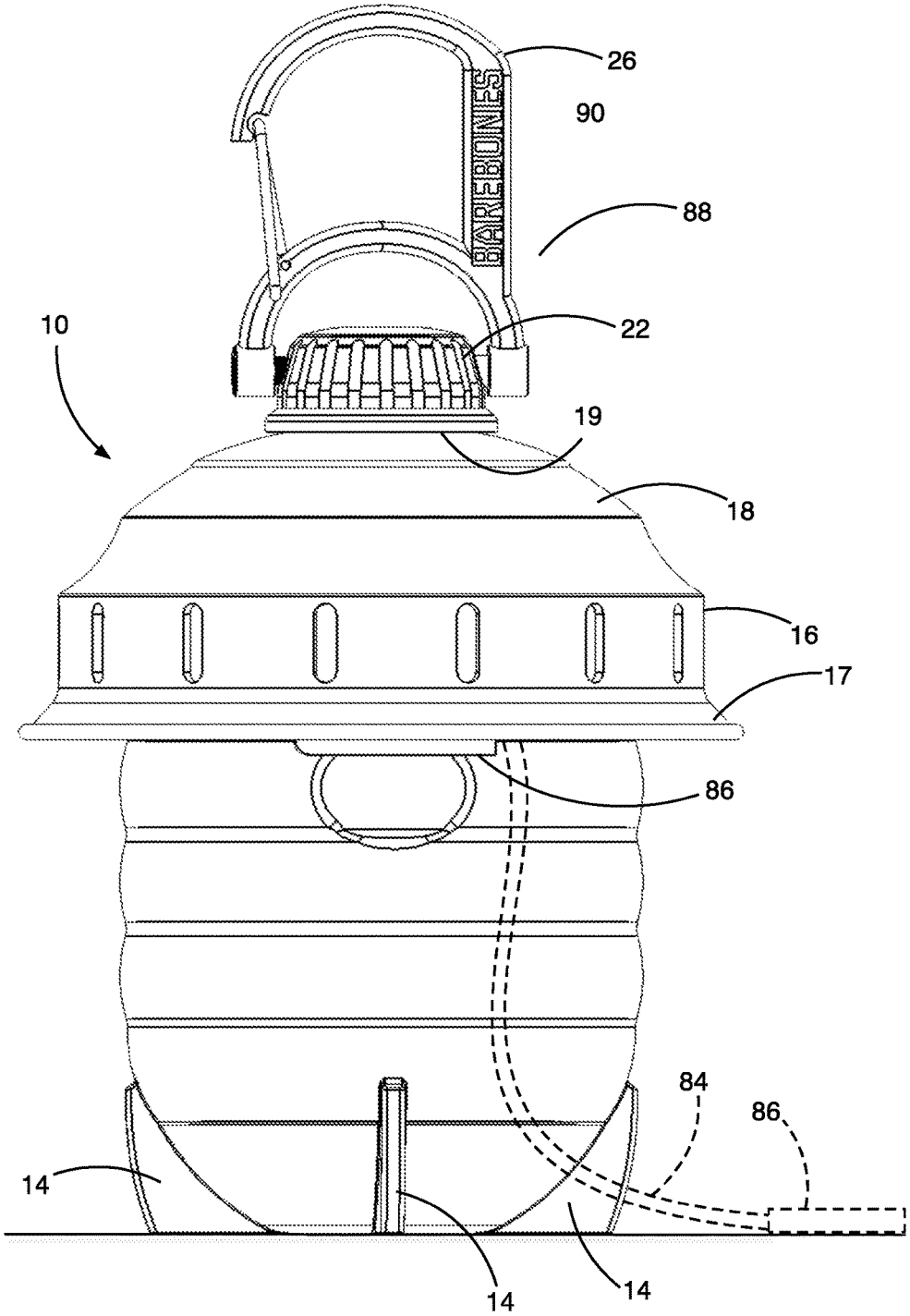
FIG. 5 is a side view of the beacon pendant light shown in FIG. 1.

As shown in FIG. 5, the upper housing 16 which includes the dome shaped top portion 18, includes an outer lower rim 17, that in combination with the knob 22, which extends over the top opening 19 in the top portion 18, will repel rain water that may fall upon the upper housing 16. This prevents the internal electronics of the light 10 from being damages due to exposure to inclement weather. The feet 14 are configured to support the light 10 in an upright position when resting on a surface as shown so that the light 10 is positioned to take advantage of the water-shielding configuration of the upper housing. Likewise, when the hook assembly 26 is used to suspend the light 10, the light will hang vertically so as to take advantage of the water-shielding configuration of the upper housing.

Figure 6:
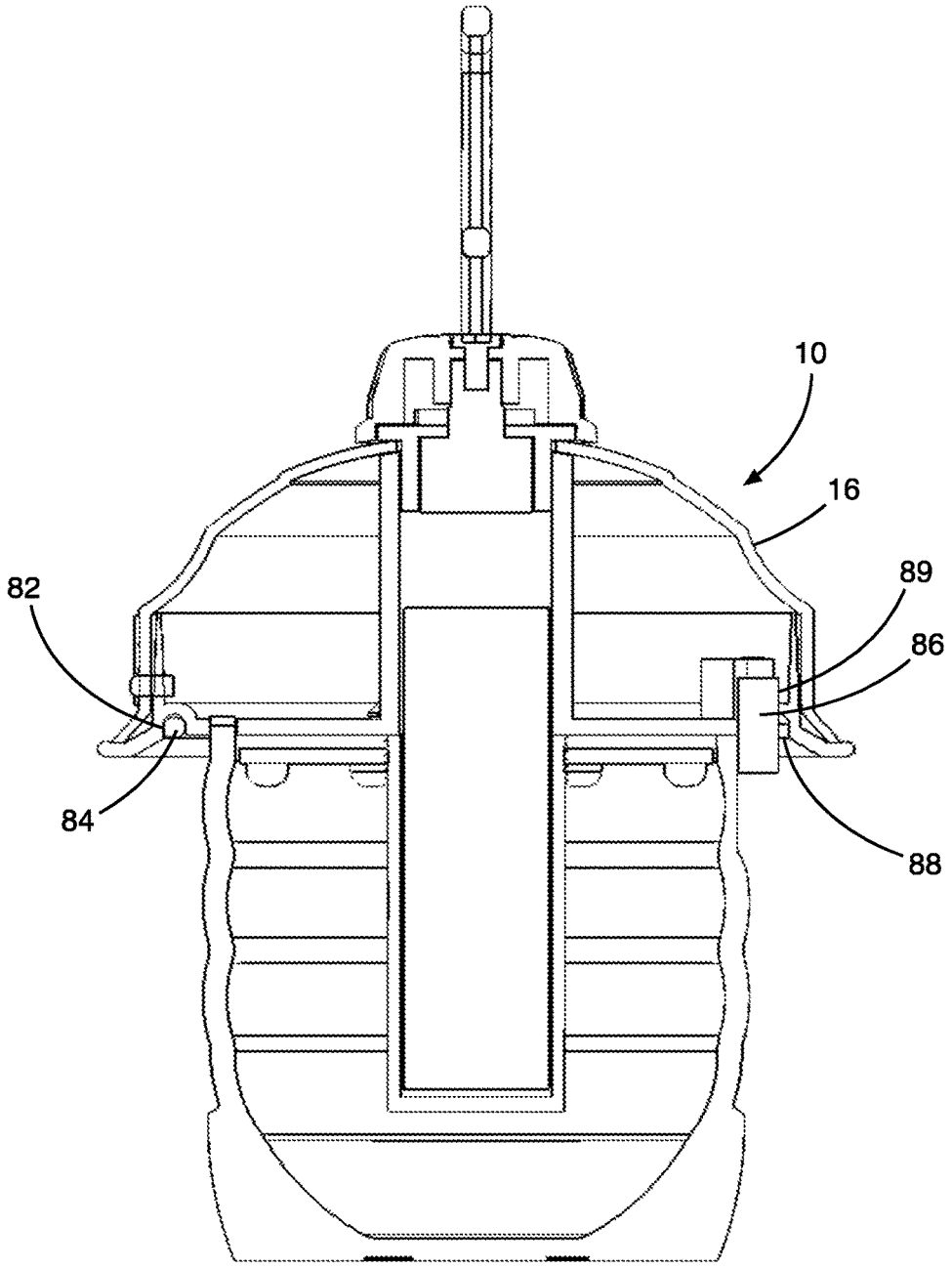
FIG. 6 is another a cross-sectional side view of the beacon pendant light shown in FIG. 1.

As further shown in FIG. 5, the USB port 86 and USB cable are nestable under the rim 17 with the USB cable 84 wrapped around the under side of the rim upper housing 16 (see FIG. 4B) proximate the rim 17, so as to provide a convenient position for the USB port 86 and USB cable 84 when not in use. When needed, the USB port 86 can be pulled down as shown in dashed lines with the USB cable 86' unwound from the under side of the upper housing 16. This nesting feature is further illustrated in FIG. 6, which shows a cross-sectional view of the light 10. The channel 82, which has a semicircular cross-section extends circumferentially around an under side of the upper housing 16. The USB cable 84 has a circular cross-section and is sized to be retained within the channel 82 by friction fit. The upper housing 16 also includes a USB port housing 88 that includes a USB port receiving recess 89 that is sized to receive and retain the USB port 86 by friction fit.

Figure 7:
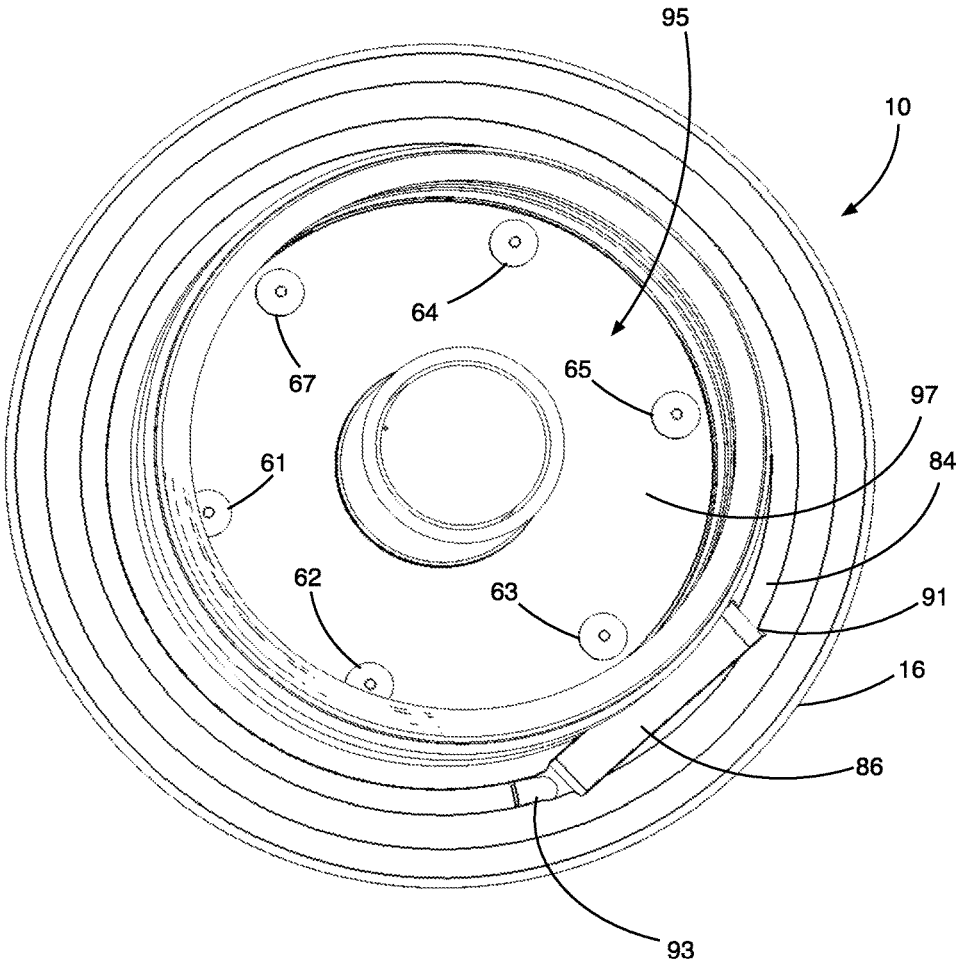
FIG. 7 is a bottom view of the top portion of the beacon pendant light shown in FIG. 1.

As further shown in FIG. 7, the USB port 86 and corresponding cable 84 wraps nearly 360 degrees around the under side of the upper housing 16, with the USB cable 84 extending from the USB port 86 at one end 91 to a second end 93 that enters the upper housing 16 to be connected to USB charging circuitry contained within the light 10.

As further shown in FIG. 7, the under side of the upper housing 16 includes the light array 95 assembly, which includes a light support plate 97 supporting six LED lights 61, 62, 63, 64, 65 and 67. More or fewer lights may be utilized depending on the brightness desired and voltage requirements of the light. Providing six evenly dispersed lights, however, does provide relatively even and consistent light distribution around the entire light 10.

There is thus disclosed an improved beacon pendant light and method of using the improved beacon pendant light. In the foregoing specification, the present invention has been described with reference to specific exemplary embodiments. Various modifications and changes may be made, however, without departing from the spirit and scope of the present invention as set forth in the claims, including combinations of elements of the various illustrated embodiments. The specification and figures are illustrative, not restrictive, and modifications are intended to be included within the scope of the present invention. Accordingly, the scope of the present invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

The phrase "consisting essentially of" as used herein is intended to cover additional elements or functions that do not materially affect the basic and novel characteristics of the claimed invention. Thus, "consisting essentially of" is intended to encompass not only those components specifically listed, but also separate or additional components that do not materially alter the specifically recited functions or elements.

The terms "comprise", "comprises", "comprising", "having", "including", "includes" or any variations of such terms, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

What is claimed is:

1. A battery-operated pendant light, comprising:

a base housing having an outer wall forming a lens;

an upper housing coupled to the base housing;

a plurality of lights coupled to the upper housing to direct light from the plurality of lights into the base housing, a battery compartment coupled to the upper housing and extending into and centrally located within the base housing, the battery compartment configured to retain at least one battery therein;

a rotatable electrical switch coupled to a top of the upper housing and a hook assembly coupled to the switch, wherein rotation of the hook assembly relative to the upper housing in a first direction moves the switch from an off position to an on position and wherein rotation of the hook assembly relative to the upper housing in a second direction opposite the first direction moves the switch from an on position to an off position, the rotatable switch being electrically coupled between the battery housing and the plurality of lights to thereby control illumination of the plurality of lights.

2. The battery-operated light of claim 1, further comprising a USB port electrically coupled to the battery housing to provide a charging capability from the USB port.

3. The battery-operated pendant light of claim 1, wherein the base housing is generally cylindrical in shape and further comprising a plurality of feet integrally formed with and radially extending from the bottom of the base housing to support the battery-operated pendant light on a surface.

4. The battery-operated pendant light of claim 1, wherein the hook assembly comprises a carabineer that is pivotally coupled to a knob that is coupled to the switch to allow the hook assembly to pivot from an upright position to a lower position.

5. The battery-operated pendant light of claim 1, wherein rotating the base housing or the upper housing relative to the hook assembly in a first direction rotates the switch assembly from an on position to an off position and rotating the base housing or the upper housing relative to the hook assembly in a second direction rotates the switch assembly from an off position to an on position.

6. The battery-operated pendant light of claim 1, wherein the battery compartment is generally cylindrical in shape and is threadedly coupled at an upper end thereof to a plate assembly that forms a bottom portion of the upper housing, the battery compartment being removable from the plate assembly.

7. The battery-operated pendant light of claim 1, wherein the base housing has a generally cylindrical shape with a dome shaped bottom portion and includes a plurality of radially extending curved rib portions that form a plurality of partial toroidal surfaces that circumferentially extend around and form the outer surface of the base portion.

8. The battery-operated pendant light of claim 2, further comprising a USB cable electrically coupled between the USB port and the battery compartment, the USB cable being removably nestable within a channel beneath a lip portion of the upper housing and at least partially circumferentially extending around the base housing when in a nested position.

9. The battery-operated pendant light of claim 5, wherein the hook assembly comprises an upper hook portion coupled to an arcuate base portion, wherein the arcuate base portion is pivotally coupled to the knob at opposite sides thereof and in a pivotal manner to allow the base portion and thus the hook portion to pivot relative to the knob at least 180 degrees.

10. The battery-operated pendant light of claim 6, wherein the base housing is releasably coupled to the plate assembly by a plurality of retaining members that extend through a corresponding plurality of slotted apertures in the plate assembly, the plurality of retaining members each forming a hook that is at least partially inserted through a corresponding one of the plurality of slotted apertures so that when the base housing is rotated relative to the upper housing, the plurality of retaining members snap lock relative to the plate assembly to releasably hold the base housing to the upper housing.

11. The battery-operated pendant light of claim 6, wherein the plurality of lights are coupled to a bottom of the plate assembly and arranged radially around the battery compartment so as to direct light into the base housing.

12. The battery-operated pendant light of claim 6, wherein the plate assembly defines a channel that circumferentially extends along the bottom of the plate assembly and is sized to receive a USB cable having a USB port attached to one end of the USB cable, the USB cable electrically coupled to the battery within the battery compartment.

13. The battery-operated pendant light of claim 6, further comprising a USB port housing coupled to the plate assembly for removably retaining the USB port therein.

14. The battery-operated pendant light of claim 9, wherein a first distal end of the arcuate base portion is coupled to the knob with a pin portion that extends at least partially into a first aperture formed in a side of the knob and wherein a second distal end of the arcuate base portion is coupled to the knob with a fastener that extends through a hole in the second distal end of the arcuate base portion and into a second aperture in an opposite side of the knob to allow the hook assembly to pivot about a pivot axis that extends through the pin portion and the fastener and wherein when the knob is rotated by the hook assembly the switch can be rotated between an off position and an on position.

15. The battery-operated pendant light of claim 11, wherein an exterior surface of the battery compartment and a bottom surface of the plate assembly are covered with a reflective material to direct substantially all of the light from the plurality of lights through the base portion in order to maximize brightness of the plurality of lights.

* * * * *